United States Patent [19]

Mondou et al.

[11] 4,453,984

[45] Jun. 12, 1984

[54] METHOD FOR REMOVING ELECTRICALLY CONDUCTIVE PASTE FROM A SCREENING MASK

[75] Inventors: Eugene R. Mondou, Poughkeepsie; Frederick W. Schneider, Ulsterville, both of N.Y.

[73] Assignee: International Business Machines Corporation, Armonk, N.Y.

[21] Appl. No.: 393,930

[22] Filed: Jun. 30, 1982

[51] Int. Cl.[3] ..... B08B 3/08; B08B 9/00

[52] U.S. Cl. ..... 134/22.19; 134/38; 134/42

[58] Field of Search ..... 134/22.19, 38, 42; 252/542, 153, 170, 171, 364

[56] References Cited

U.S. PATENT DOCUMENTS

| | | | |
|---|---|---|---|
| T957,003 | 5/1977 | Freshour | 134/4 |
| 3,673,099 | 6/1972 | Corby et al. | 252/156 |
| 3,706,691 | 12/1972 | Duffy et al. | 252/364 |
| 4,085,059 | 4/1978 | Smith et al. | 252/118 |
| 4,276,186 | 6/1981 | Bakos et al. | 252/158 |
| 4,304,536 | 12/1981 | Davis et al. | 425/811 X |
| 4,395,479 | 7/1983 | Ward et al. | 134/38 X |

*Primary Examiner*—Marc L. Caroff

*Attorney, Agent, or Firm*—Wolmar J. Stoffel

[57] ABSTRACT

A process for cleaning both polar and non-polar residue material from screening masks, wherein the mask is contacted with a liquid solvent that at least includes a solvent selected from the group consisting of N-Cyclohexyl-2-Pyrrolidone, N-Isopropyl-2-Pyrrolidone, Ethyl Hexyl Acetate, Dibutyl Cartitol and MAGIE OIL #543.

12 Claims, No Drawings

METHOD FOR REMOVING ELECTRICALLY CONDUCTIVE PASTE FROM A SCREENING MASK

DESCRIPTION

1. Technical Field

The present invention relates to removal of solid and very viscous residue containing both polar and non-polar materials. More particularly the invention is concerned with cleaning paste residue from screening masks with solvents that effectively clean away the paste residue but do not present health and/or fire or explosion hazards.

2. Background Art

Conductive metal patterns are used extensively in semiconductor packaging structures. These patterns are used for providing printed circuits to fan out the small geometry of the semiconductor device terminals, to provide electrical wiring connections between semiconductor devices mounted on the same substrate, and to provide electrical connections between devices and I/O connectors for establishing external electrical contact.

A very common method for depositing conductive metal patterns is depositing conductive paste through openings in a mask that is placed in direct contact with the substrate. An apparatus for performing such a paste screening operation is described in U.S. Pat. No. 3,384,931.

As the geometry of the semiconductor devices becomes more dense, the spacing of the terminals is correspondingly decreased, necessitating smaller screening patterns on the substrates that support the devices. Further, the increased speed of the devices makes it more desirable to reduce the distance between devices thereby providing a further constraint on mask and screening dimensions. As the size of the mask openings decrease, the maintaining of the integrity of the screened lines and related pattern geometry becomes more difficult. With many paste compositions it has been found necessary to clean the screening mask after each use to remove any paste residue remaining from the previous paste screening operation. The cleaning operations is particularly critical when screening fine line patterns.

The screening mask can conveniently be cleaned automatically after each use with a screening apparatus described in U.S. Pat. No. 4,304,536. In this apparatus the screening mask is sprayed with a solvent, following use, to remove any remaining paste residue, and the mask subsequently dried before each screening operation. In use it is common to use a variety of conductive pastes, particularly in the fabrication of multi-layer ceramic (MLC) substrate of the type described in U.S. Pat. No. 4,245,273. Pastes with different resin binders and solvents are necessary to control the interaction with the ceramic green sheet for different paste areas involved in differing conductive circuit patterns. The pastes can use resin-solvent systems that vary from non-polar to very polar in nature. It is therefore important that the solvent used for cleaning masks be effective in cleaning resin-solvent systems that are both polar and non-polar.

Perchlorothylene (PCE) is a well known solvent that is widely used, which is capable of effectively cleaning non-polar as well as polar resin-solvent system materials. However, PCE has recently been placed on the OSHA suspect carcinogen list because it may be a cancer-causing agent. If the suspicions should prove correct and PCE is declared a known carcinogen, the tolerable permissible levels in the working area would be drastically reduced to levels that could not be met and maintained in a manufacturing environment. This would require the selection of a different solvent capable of performing the cleaning operation of PCE that is a non-carcinogenic, that is non-flammable, preferably with a flash point greater than 180° F. In addition the solvent must have a low toxicity, be a low pollutant, and be non-halogenated. Preferably the solvent should be non-corrosive to the screening mask and the apparatus, be effective at a low temperature, and be recyclable.

DISCLOSURE OF THE INVENTION

An object of the invention is to provide a process for cleaning residue from objects, wherein the residue includes both polar and non-polar materials.

Another object of the invention is to provide a process for removing polar and non-polar materials from objects which uses a non-carcinogenic solvent.

Yet another object of the invention is to provide a safe and non-polluting process for cleaning screening masks.

In accordance with our invention, there is provided a process for cleaning residues of polar and non-polar materials wherein the object to be cleaned is contacted with a liquid solvent that at least includes a solvent selected from the group consisting of N-Cyclohexyl-2-Pyrrolidone, N-Isopropyl-2-Pyrrolidone, Ethyl Hexyl Acetate, Dibutyl Carbitol, MAGIE OIL* #543 and mixtures thereof.

*A trademark of Magie Bros. Oil Company, Franklin Park, Ill.

BEST MODE FOR CARRYING OUT THE INVENTION

In the practice of preferred method embodiments of our invention, the selection of a solvent to effectively remove residue of polar, non-polar and all degrees of polarity in between, of resin-solvent systems commonly used in conductive screening pastes was critical. The solvent selected must be re-cyclable, i.e., capable of being filtered and/or distilled to remove residual and paste components. More importantly, the solvent must be non-carcinogenic, low toxicity, and non-flammable, preferably with a flash point greater than 180° F. In addition the solvent should be non-corrosive to mask materials and apparatus, and preferably operate at low temperatures, on the order of room temperature. In general the solvent should possess the cleaning capabilities of PCE, but not have the potential pollution and suspicion of being a carcinogen, presently associated with PCE.

In selecting the solvents to be used, an extensive literature search was made to compile a list of known and preferably commercially available solvent systems which included their physical characteristics such as solubility parameters, flash point, viscosity, molecular weight, density, vapor pressure, etc.

In making the first pass, all halogenated solvents were ruled out on the basis of their potential of being a carcinogen. Water-base cleaning solutions were also ruled out because of their corrosive potential on iron elements in the screening apparatus, and also because they contain surfactants and dispersants that would present special problems in treatment or recovery. All solvents that failed to meet the flammability requirement were also ruled out.

The data characterizing the solvents remaining was carefully scrutenized to make a further selection. However reliance completely on this information was not possible since the problem of cleaning the paste residue involves dealing with complex organic and inorganic components of different paste systems where the interaction is not predictable. An effort was made to determine the solubility parameters of PCE and then make a selection of other solvents with similar characterizing parameters. However, it was discovered that the polar and non-polar parameters of PCE appear to be unique to halogenated solvents, which general class of solvents had been ruled out. The corresponding parameters of the remaining solvents could not be compared.

It was determined that the suitable solvents could only be discovered by experimentally determining the performance of each solvent.

In order to determine the suitability of the various solvents for cleaning paste residue, three different conductive pastes were prepared, each with a different resin-solvent system. The first solvent-resin system, composed of a mixture of ethyl cellulose and butyl carbitol acetate, was highly polar. The second solvent-resin system, composed of a mixture of an ester-alcohol, and ethyl cellulose, was only slightly polar. The third solvent-resin system composed of a mixture of a hydrocarbon resin and a hydrocarbon solvent was non-polar. The effectiveness of the various solvents on the aforementioned conductive paste was measured by an impingement test and an immersion test and the results compared. Further, the tests were performed at different temperatures. The selection of the solvents to be used in our process was made on this basis.

The impingement test consisted basically of coating microscope slides with the aforementioned types of paste, mounting each slide at a 45° angle a predetermined distance beneath a dropping funnel and allowing a measured amount of the solvent being tested to impinge on the coated slide. The impingement of the solvent was repeated at timed intervals, resulting in an impingement and a soak period. The end point of the test is taken as the number of solvent cycles necessary to solvate or clean a path through to the bottom edge of the coated slide. The apparatus is illustrated and the tests were described in detail in IBM TDB Vol. 24 No. 11B April 1982 Page 6002. The experimental data that can be obtained with this test are the wetting and spreading pattern, the breakthrough time at the point of impact, the final end point, the nature of the cleaned pattern size and shape, the effect of temperature on the cleaning action, and film lifting and adhesion.

In the immersion test coated slides are immersed in the solvent under test, and the solvent stirred. The cleaning action of the solvent on the paste is noted and compared. The test is done at different temperatures. The factor of time can be introduced by lowering the solvent filled container relative to the coated slide at regular time intervals.

In accordance with the cleaning method of our invention it was discovered that N-Cyclohexyl-2-Pyrrolidone, N-Isopropyl-2-Pyrrolidone, Ethyl Hexyl Acetate, MAGIE OIL #543 and Dibutyl Carbitol were effective in removing both polar and non-polar residue when the object to be cleaned is contacted with the solvents. Contact can be made by immersion, preferably with agitation, spraying, or a combination of immersion and spraying. The solvent can be contacted at any suitable temperature below the boiling point. Preferably the solvent is used at or slightly above room temperature. The selected solvent can be used in combination with other liquid solvents if conditions permit. However, combinations of solvents normally complicate the recycle process for re-using the solvent. Re-cycle processes usually depend on a distillation step. In distilling combinations of liquids with different vapor pressure, the maintenance of a fixed ratio of solvents presents complex testing and make-up addition problems. For this reason it is desirable to use a single solvent or an azeotropic mixture of solvents.

It has been discovered that N-Cyclohexyl-2-Pyrrolidone and Dibutyl Carbitol are effective in removing polar and non-polar resins at temperatures from 15° C. to the boiling points. The preferred range for cleaning is from 15° to 70° C., most preferably at room temperature.

Ethyl Hexyl Acetate, N-Isopropyl-2-Pyrrolidone, and MAGIE OIL #543 were discovered to be the most effective at cleaning polar and non-polar residue at higher temperatures preferably in the range of 50° to 70° C., most preferably at 60° C.

MAGIE OIL #543 is a completely aromatic distillate product of Magie Bros. Oil Company of 9101 Fullerton Avenue, Franklin Park, Ill. 60131. It has a light green color, a mild aromatic odor, a specific gravity of 0.9965, a flash point of 225° F., a refractive index of 1.5963, a K.B. number of 100, and an average molecular weight of 165.

The specific cleaning action of the aforementioned solvents or combinations of polar and non-polar residue is unpredictable and unexpected.

The following examples are included to illustrate preferred embodiments and aspects thereof of the invention and are not intended to unduly limit the scope of the claims that define the invention.

EXAMPLE I

In order to test the effectiveness of conductive pastes of varying polarity, three different pastes with resin-solvent systems which varied from non-polar to very polar were prepared. A first highly polar paste was prepared using an ethyl cellulose resin and a Butyl Carbitol Acetate solvent. A second slightly polar paste was prepared also using an Ethyl Cellulose Resin and Texanol (2,2,4 Trimethyl Pentane Diol 1,3 Monoiso-Butyrate) solvent. A third polar paste was prepared using AB-180 resin and AMSCO 550 oil as a solvent.

Microscope slides were coated with the aforedescribed pastes. Slides were used to insure consistent surface characteristics for uniform coating adhesion. Uniform paste thicknesses were applied using a number nine wire-wound coating rod.

The slides were sequentially mounted on a 45° angle at a predetermined distance beneath a dropping funnel using the apparatus illustrated in IBM TDB Vol. 24 No. 11B April 1982 page 6002. The solvent to be tested was then applied to the paste. By turning the funnel stopcock 180°, a premeasured volume of solvent was allowed to drop and impinge on the coated slide. The process was repeated every 10 seconds, resulting in an impingement and a subsequent soak period. The end point was taken as the number of solvent cycles necessary to solvate or clean a path through to the bottom edge of the coated slide. Solvents which exhibited no solvency or very little solvency for a paste were stopped at fifty cycles. If there was any indication of cleaning, the test was carried to completion. When the solvents were too viscous at room temperature they were also tested at elevated temperature, i.e., 60° C.

The following solvents were tested by the above procedure on their effect on each of the aforedescribed pastes. The initial runs were made with the solvent at room temperature and the results indicated on the table. Some solvents have the results indicated by two numbers. The first number represents the number of cycles required to clear a path through the paste. This initial cleaned path does not normally extend to the full width of the area wetted by the solvent (wetting pattern). The second number represents the number of cycles required to clean the paste area to the edge of the wetting pattern. The designation NEP indicates that the solvent had no end point.

| | PASTE | | |
|---|---|---|---|
| Solvent | #1-Highly Polar | #2-Mildly Polar | #3-Non-Polar |
| 1. Perchlorothylene (control) | 12 | 9 | 6 |
| 2. Butyl Carbitol | 43/54 | 43/60 | NEP |
| 3. Methyl Carbitol | 56 | NEP | NEP |
| 4. Hexyl Carbitol | 73/89 | 75/83 | NEP |
| 5. Carbitol | NEP | NEP | NEP |
| 6. Texanol (1,2,24-Trimethyl Pentane 1,3 Monoisobutyrate) | NEP | NEP | NEP |
| 7. Butyl Carbitol Acetate | 38 | NEP | NEP |
| 8. N—Cyclohexyl-2-Pyrrolidone | 41/67 | 33/53 | 16/20 |
| 9. N—Isopropyl-2-Pyrrolidone | 20/32 | 31/45 | NEP |
| 10. N—Methyl-2-Pyrrolidone | 21 | 27 | NEP |
| 11. Norpar 12 (Mixture of Petroleum Hydrocarbons) | NEP | NEP | 11/17 |
| 12. Norpar 13 (Mixture of Petroleum Hydrocarbons) | NEP | NEP | 11/17 |
| 13. Butyl Cellosolve | 36 | 73 | NEP |
| 14. Isopar M | NEP | NEP | 18/27 |
| 15. Magie Oil #470 | NEP | NEP | 16/22 |
| 16. Dibutyl Carbitol | 30/37 | 23/49 | 17/35 |
| 17. 2-Ethyl Hexyl Acetate | 41/58 | 41/NEP | 18/NEP |
| 18. Magie Oil #543 | 30/40 | SR* | 16/22 |

*Indicates some removal but not the normal cleaning pattern.

Perchloroethylene was used as a control solvent and effectively cleaned away all three types of paste forming a keyhole shaped pattern that served as an end point standard for the solvents tested. Solvents 2 through 5 were carbitols. Note that solvents 2 and 4 cleaned pastes 1 and 2 but not 3. Solvent 3 cleaned only paste 1, while solvent 5 didn't effectively clean any of the pastes. Solvents 7 and 6 are the same solvents used in paste 1 and 2. respectively. Solvent 7 cleans paste 1, but does not clean paste 2 and 3. Solvent 6 does not clean any of the pastes including paste 2 which embodies the solvent. This is somewhat unexpected and points up the problems in selecting a solvent to meet the demanding requirements of mask cleaning. Solvents 8 through 10 are pyrrolidones. Note that solvent 8 effectively cleans all three pastes at room temperature. However, solvents 9 and 10 do not clean paste 3. Solvents 11, 12, 14 and 15 are various mixtures of petroleum hydrocarbons. These solvents are effective in cleaning paste 3. Solvent 13, butyl cellosolve, was ineffective in cleaning paste 3. Solvent 16 effectively cleaned all the pastes at room temperature. Solvent 17 formed a path in all 3 pastes but failed to widen the path in pastes 2 and 3. Solvent 18 (MAGIE OIL #543) cleaned both paste 1 and paste 3, but would not clean paste 2 at room temperature. In summary, only solvents 8, 16 and 17 i.e., N Cyclohexyl-2-Pyrrolidone, Dibutyl Carbitol and 2-Ethyl Hexyl Acetate are capable of cleaning all 3 pastes at room temperature.

EXAMPLE II

A number of solvents were selected for further testing at elevated temperatures. Using the same procedure, except that the solvent and the paste sample were maintained at 60° C. by appropriate heated jackets and enclosures, the following solvents were tested.

| | Room Temperature 60° C. | | | | | |
|---|---|---|---|---|---|---|
| | I083 BCA | RGT Texanol | GNCC 550 Oil | 1083 BCA | RGT Texanol | GNCC 550 Oil |
| 1. Perchlorethylene | 12 | 9 | 6 | 9 | 8 | 5 |
| 2. N—Isopropyl-2-Pyrrolidone | 20/32 | 31/45 | NEP | 9/15 | 9/13 | 27/32 |
| 3. N—Methyl-2-Pyrrolidone | 21 | 27 | NEP | 15/26 | 12/22 | NEP |
| 4. N—Cyclohexyl-2-Pyrrolidone | 41/67 | 33/53 | 16/20 | 38/56 | 23/31 | 15/18 |
| 5. Dibutyl Carbitol | 30/37 | 23/49 | 17/35 | 22/28 | 19/33 | 16/26 |
| 6. 2-Ethyl Hexyl Acetate | 41/58 | 41/NEP | 18/NEP | 17/25 | 20/27 | 15/23 |
| 7. Cellosolve | 20 | 28 | NEP | 14/18 | 24/34 | NEP |
| 8. Magie Oil #543 | 30/40 | SR* | 16/22 | 21/29 | 21/31 | 16/23 |

The test data for room temperature is reproduced in this table from the previous Example for the convenience of comparison.

Solvent 1, perchlorethylene, is slightly more effective at elevated temperatures. Solvents 2 and 3 failed to dissolve paste 3 at room temperature. However, at 60° C. solvent 2 effectively cleaned all three pastes, while solvent 3 again failed to clean paste 3. Solvents 2, 3 and 4 are all pyrrolidones, yet each have a different cleaning performance which is not predictable. Solvents 4 and 5 were effective as cleaning all 3 pastes at room temperature and are also effective in cleaning solvents at 60° C. Solvent 6, Ethyl Hexyl Acetate, lacked the cleaning ability to widen the path in pastes 2 and 3 at room temperature but was effective at 60° C. Solvent 7 could not clean paste 3 at room temperature. However, it appears to be more effective at 60° C. for two pastes.

Solvent 8 (MAGIE OIL #543) could not clean paste 2 at room temperature. However, it was effective in cleaning paste 2 at 60° C.

In summary, solvent 6 (Ethyl Hexyl Acetate), solvent 2 (N-Ispopropyl-2-Pyrrolidone) and MAGIE OIL #543 are effective in cleaning all three pastes at elevated temperatures. Solvent 4 (N-Cyclohexyl-2-Pyrrolidone) and solvent 5 (Dibutyl Carbitol) are effective in cleaning all three pastes at both room temperature and at elevated temperatues.

While the invention has been illustrated and described with reference to preferred embodiments thereof, it is to be understood that the invention is not limited to the precise construction herein disclosed and the right is reserved to all changes and modifications coming within the scope of the invention as defined in the appended claims.

We claim:

1. In a process for independently removing polar and non-polar residues of electrically conducting screening paste embodying at least an electrical conductive material, a resin, and a solvent for the resin, from screening masks, the improvement comprising contacting the mask to be cleaned with a liquid solvent that at least includes a solvent selected from the group consisting of N-Cyclohexyl-2-Pyrrolidone, N-Isopropyl-2-Pyrrolidone, Ethyl Hexyl Acetate, Dibutyl Carbitol, and mixtures thereof.

2. The process of claim 1 wherein said solvent is N-Cyclohexyl-2-Pyrrolidone.

3. The process of claim 1 wherein said solvent is maintained at temperatures in the range of 15° to 70° C.

4. The process of claim 2 wherein the temperature of the solvent during contacting of the mask is approximately 20° C.

5. The process of claim 1 wherein said solvent is Dibutyl Carbitol.

6. The process of claim 5 wherein said solvent is maintained at temperatures in the range of 15° to 70° C.

7. The process of claim 5 wherein the temperature of the solvent during contacting of the mask is approximately 20° C.

8. The process of claim 1 wherein said solvent is N-Isopropyl-2-Pyrrolidone.

9. The process of claim 8 wherein said solvent is maintained at temperatures in the range of 50° to 70° C.

10. The process of claim 1 wherein said solvent is Ethyl Hexyl Acetate.

11. The process of claim 10 wherein said solvent is maintained at temperatures in the range of 50° to 70° C.

12. The method of claim 1 wherein said mask is contacted by spraying said liquid solvent onto said mask.

* * * * *

UNITED STATES PATENT AND TRADEMARK OFFICE

CERTIFICATE OF CORRECTION

PATENT NO. : 4,453,984

DATED : Jun. 12, 1984

INVENTOR(S) : Eugene R. Mondou and Frederick W. Schneider

It is certified that error appears in the above-identified patent and that said Letters Patent is hereby corrected as shown below:

In the Abstract, line 6

Cartitol should read --Carbitol--

Signed and Sealed this

*Twenty-third* Day of *October 1984*

[SEAL]

*Attest:*

GERALD J. MOSSINGHOFF

*Attesting Officer*

*Commissioner of Patents and Trademarks*